US008408130B2

(12) United States Patent
Burberry et al.

(10) Patent No.: US 8,408,130 B2
(45) Date of Patent: Apr. 2, 2013

(54) METHOD OF MAKING FLEXOGRAPHIC PRINTING MEMBERS

(75) Inventors: Mitchell S. Burberry, Webster, NY (US); Christine J. Landry-Coltrain, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 213 days.

(21) Appl. No.: 12/868,054

(22) Filed: Aug. 25, 2010

(65) Prior Publication Data

US 2012/0048135 A1 Mar. 1, 2012

(51) Int. Cl.
*B41F 33/00* (2006.01)

(52) U.S. Cl. ..... 101/483; 101/368

(58) Field of Classification Search ..... 101/483
See application file for complete search history.

(56) References Cited

U.S. PATENT DOCUMENTS

| | | | | |
|---|---|---|---|---|
| 4,101,324 | A | 7/1978 | Mizuno et al. | |
| 4,610,950 | A | 9/1986 | Milliken | |
| 4,927,723 | A | 5/1990 | Cusdin | |
| 5,813,342 | A | 9/1998 | Strong | |
| 5,892,588 | A | 4/1999 | Samworth | |
| 5,894,799 | A * | 4/1999 | Bart et al. | 101/376 |
| 6,213,018 | B1 * | 4/2001 | Samworth | 101/395 |
| 6,445,465 | B1 | 9/2002 | Samworth | |
| 6,698,354 | B2 * | 3/2004 | Juffinger et al. | 101/401.1 |
| 6,984,478 | B2 | 1/2006 | Dreher et al. | |
| 7,126,724 | B2 | 10/2006 | McCrea et al. | |
| 7,245,402 | B2 | 7/2007 | McCrea et al. | |
| 7,419,766 | B2 * | 9/2008 | Kimelblat et al. | 430/302 |
| 7,486,420 | B2 | 2/2009 | McCrea et al. | |
| 7,875,321 | B2 * | 1/2011 | Verhoest et al. | 427/511 |
| 2004/0183796 | A1 * | 9/2004 | Velde et al. | 345/419 |
| 2005/0115920 | A1 * | 6/2005 | Hiller et al. | 216/10 |
| 2005/0157347 | A1 | 7/2005 | Dewitte | |
| 2007/0190452 | A1 * | 8/2007 | Kimelblat et al. | 430/270.1 |
| 2008/0258344 | A1 | 10/2008 | Regan et al. | |
| 2009/0059304 | A1 | 3/2009 | Manfredi et al. | |

OTHER PUBLICATIONS

"Direct laser plate making Consideration for current status" by Assoc. of Japanese Flexo printing industry, Issued Feb. 1, 2010.
"Flexo's New Resolution" by Ian Hole, *FLEXO*, Apr. 2009.
"High Definition Flexo A new horizon for flexo printing" *EskoArtwork* 2009.
U.S. Appl. No. 12/581,926, filed Oct. 20, 2009, entitled Laser-Ablatable Elements and Methods of Use, by Landry-Coltrain et al.

* cited by examiner

*Primary Examiner* — Anthony Nguyen
(74) *Attorney, Agent, or Firm* — J. Lanny Tucker

(57) ABSTRACT

An imaging method provides a flexographic printing member used to transfer ink from an image area to a receiver element. This flexographic printing member has a relief image including an image area that is composed of an elastomeric composition that has an elastomeric topmost surface and a relief image floor. The relief image has a plurality of dots within a sub-area of the elastomeric topmost surface wherein each dot has a minimum receiver element contact area. A fraction less than 1 of the plurality of dots, known as (b) dots, have a topmost surface that is undercut below the elastomeric topmost surface. The (b) dots are undercut below the elastomeric topmost surface in a predetermined number and arrangement so that the (b) dots are still able to transfer ink to the receiver element. Each of the remainder of the plurality of dots in the sub-area, known as (a) dots, has a topmost surface that is essentially coincident with the elastomeric topmost surface.

20 Claims, 5 Drawing Sheets

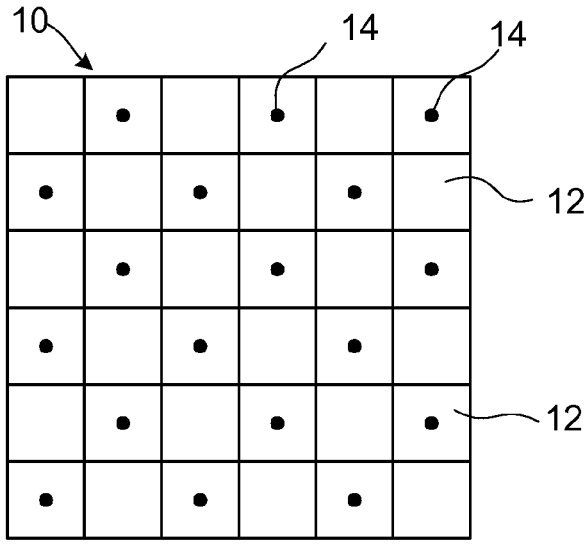
FIG. 1-A
(PRIOR ART)
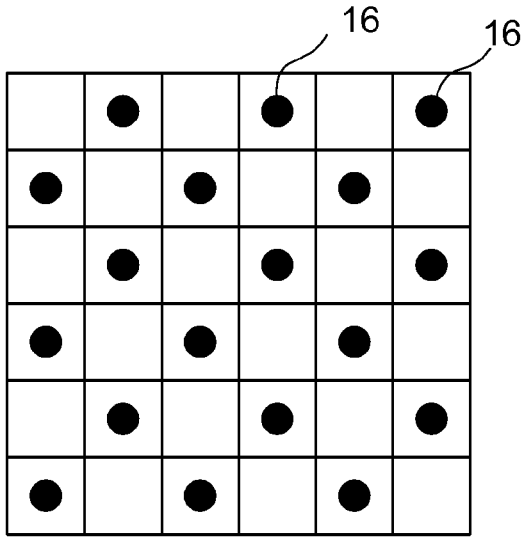
FIG. 1-B
(PRIOR ART)
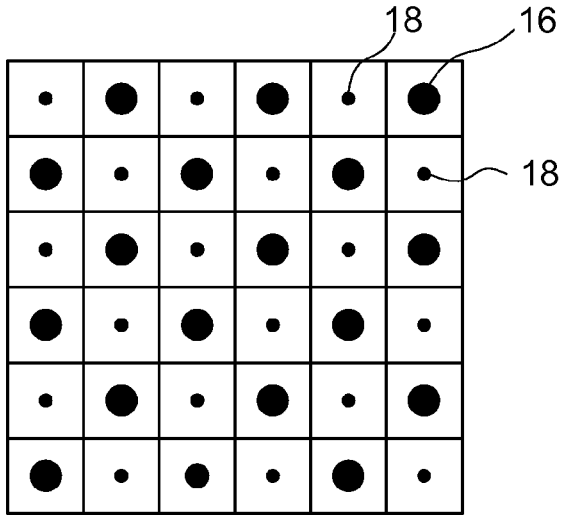
FIG. 1-C
(PRIOR ART)

| | | | | | | | | | | | |
|---|---|---|---|---|---|---|---|---|---|---|---|
| 45 | 20 | 38 | 52 | 53 | 56 | 42 | 11 | 27 | 54 | 53 | 52 |
| 48 | 27 | 54 | 33 | 55 | 52 | 38 | 0 | 20 | 48 | 56 | 50 |
| 56 | 55 | 50 | 0 | 27 | 57 | 33 | 48 | 33 | 45 | 55 | 57 |
| 42 | 53 | 11 | 57 | 45 | 20 | 54 | 50 | 42 | 0 | 11 | 38 |
| 56 | 45 | 20 | 42 | 11 | 27 | 38 | 53 | 33 | 42 | 54 | 11 |
| 11 | 38 | 0 | 52 | 48 | 50 | 54 | 0 | 0 | 56 | 50 | 48 |
| 27 | 33 | 48 | 55 | 45 | 52 | 56 | 42 | 52 | 53 | 57 | 27 |
| 57 | 50 | 53 | 54 | 33 | 57 | 20 | 55 | 20 | 45 | 55 | 38 |
| 55 | 27 | 54 | 0 | 33 | 42 | 54 | 11 | 50 | 42 | 48 | 56 |
| 48 | 20 | 38 | 56 | 0 | 56 | 50 | 48 | 55 | 38 | 33 | 20 |
| 42 | 33 | 50 | 11 | 52 | 53 | 57 | 27 | 52 | 57 | 27 | 11 |
| 57 | 52 | 53 | 45 | 20 | 45 | 55 | 38 | 54 | 0 | 53 | 45 |

FIG. 3a

| | | | | | | | | | | | |
|---|---|---|---|---|---|---|---|---|---|---|---|
| 11 | 52 | 55 | 27 | 11 | 52 | 55 | 27 | 11 | 52 | 55 | 27 |
| 54 | 42 | 56 | 45 | 54 | 42 | 56 | 45 | 54 | 42 | 56 | 45 |
| 50 | 57 | 0 | 53 | 50 | 57 | 0 | 53 | 50 | 57 | 0 | 53 |
| 20 | 38 | 48 | 33 | 20 | 38 | 48 | 33 | 20 | 38 | 48 | 33 |
| 11 | 52 | 55 | 27 | 11 | 52 | 55 | 27 | 11 | 52 | 55 | 27 |
| 54 | 42 | 56 | 45 | 54 | 42 | 56 | 45 | 54 | 42 | 56 | 45 |
| 50 | 57 | 0 | 53 | 50 | 57 | 0 | 53 | 50 | 57 | 0 | 53 |
| 20 | 38 | 48 | 33 | 20 | 38 | 48 | 33 | 20 | 38 | 48 | 33 |
| 11 | 52 | 55 | 27 | 11 | 52 | 55 | 27 | 11 | 52 | 55 | 27 |
| 54 | 42 | 56 | 45 | 54 | 42 | 56 | 45 | 54 | 42 | 56 | 45 |
| 50 | 57 | 0 | 53 | 50 | 57 | 0 | 53 | 50 | 57 | 0 | 53 |
| 20 | 38 | 48 | 33 | 20 | 38 | 48 | 33 | 20 | 38 | 48 | 33 |

FIG. 3b

METHOD OF MAKING FLEXOGRAPHIC PRINTING MEMBERS

RELATED APPLICATION

Copending and commonly assigned U.S. Ser. No. 12/868,039 (filed on even date herewith by Burberry and Landry-Coltrain), which is entitled "Flexographic Printing Members".

FIELD OF THE INVENTION

This invention relates to the field of flexographic printing. More particularly, this invention relates to improved direct engraving methods for preparing flexographic printing members. The flexographic printing members can be flexographic printing plates, sleeves, and cylinders that exhibit improved dot gain control.

BACKGROUND OF THE INVENTION

Flexography is a method of printing that is commonly used for high-volume relief printing runs on a variety of substrates such as paper, paperstock board, corrugated board, polymeric films, labels, foils, fabrics, and laminates. Flexographic printing has found particular application in packaging, where it has displaced rotogravure and offset lithography printing techniques in many cases.

Flexographic printing members are sometimes known as "relief printing members" and are provided with raised relief images onto which ink is applied for application to a receiver element of some type. The raised relief images are inked in contrast to the relief "floor" that remains free of ink. Such flexographic printing members (such as flexographic printing plates) are supplied to the user as an article having one or more layers optionally on a substrate or backing material. Flexographic printing can be carried out using flexographic printing plates as well as flexographic printing cylinders or seamless sleeves having a desired relief image.

Generally, flexographic printing members are produced from a photosensitive resin or elastomeric rubber. A photomask, bearing an image pattern can be placed over the photosensitive resin sheet and the resulting masked resin is exposed to light, typically UV radiation, to crosslink the exposed portions of the resin, followed by developing treatment in which the unexposed portions (non-crosslinked) of the resin are washed away with a developing liquid. Recent developments have introduced the CTP (computer-to-plate) method of creating the mask for the photosensitive resin. In this method, a thin (generally 1-5 μm in thickness) light absorption black layer is formed on the surface of the photosensitive resin plate and the resulting printing plate is irradiated imagewise with an infrared laser to ablate portions of the mask on the resin plate directly without separately preparing the mask. In such systems, only the mask is ablated without ablating the photosensitive plate precursor. Subsequently, the photosensitive plate precursor is imagewise exposed to UV light through the ablated areas of the mask, to crosslink (or harden) the exposed portions of the photosensitive resin, followed by developing treatment in which the unexposed portions (uncrosslinked) of the resin and the remaining black mask layer are washed away with a developing liquid. Both these methods involve a developing treatment that requires the use of large quantities of liquids and solvents that subsequently need to be disposed of. In addition, the efficiency in producing flexographic printing plates is limited by the additional drying time of the developed plates that is required to remove the developing liquid and dry the plate. Often additional steps of post-UV exposure or other treatments are needed to harden the surface of the imaged printing plate.

While the quality of articles printed using flexographic printing plates has improved significantly as the technology has matured, physical limitations related to the process of creating a relief image in a printing member still remain.

In the flexographic printing process, a flexographic printing member having a three-dimensional relief image formed in the printing surface is pressed against an inking unit (normally an Anilox roller) in order to provide ink on the topmost surface of the relief image. The inked raised areas are subsequently pressed against a suitable substrate that is mounted on an impression cylinder. As the flexographic printing member and Anilox or substrate are adjusted or limited mechanically, the height of the topmost surface determines the amount of physical impression pressure between the flexographic printing member and the Anilox or the flexographic printing member and the substrate. Areas in the relief image that are raised higher than others will produce more impression than those that are lower or even recessed. Therefore, the flexographic printing process is highly sensitive to the impression pressure that may affect the resulting image. Thus, the impression pressure must be carefully controlled. If the impression pressure is too high, some image areas can be squeezed, and if it is too low, ink transfer is insufficient. To provide the desired images, a pressman may test impression pressure settings for a given flexographic printing plate.

In particular, it is very difficult to print graphic images with fine dots, lines, and even text using flexographic printing members. In the lightest areas of the image (commonly referred to as "highlights"), the density of the image is represented by the total area of printed dots in a halftone screen representation of a continuous tone image. For Amplitude Modulated (AM) screening, this involves shrinking a plurality of halftone dots located on a fixed periodic grid to a very small size, the density of the highlight being represented by the area of the halftone dots. For Frequency Modulated (FM) screening, the size of the halftone dots is generally maintained at some fixed value, and the number of randomly or pseudo-randomly placed halftone dots represent the density of the image. In both of these situations, it is necessary to print very small dot sizes to adequately represent the highlight areas.

Maintaining small halftone dots on a flexographic printing member is very difficult due to the nature of the plate making process and the small size and lack of stability in the halftone dots. Digital flexographic printing precursors usually have an integral UV-opaque mask layer coated over a photopolymer or photosensitive layer in the relief image. In a pre-imaging (or post-imaging) step, the floor of the relief image in the printing member is set by area exposure to UV light from the back of the printing precursor. This exposure hardens the photopolymer to the relief depth required for optimal printing. This step is followed by selective ablation of the mask layer with an imagewise addressable high power laser to form an image mask that is opaque to ultraviolet (UV) light in non-ablated areas. Flood exposure to image-forming UV radiation and chemical processing are then carried out so that the areas not exposed to UV are removed in a processing apparatus using developing solvents, or by a heating and wicking process. The combination of the mask and UV exposure produces relief halftone dots that have a generally conical shape. The smallest of these halftone dots are prone to being removed during processing, which means no ink is transferred to these areas during printing (the halftone dot is not "held" or formed on the printing plate or on the printing press). Alternatively, if the small halftone dots survive processing, they are susceptible to damage on press. For example, small halftone dots often fold over or partially break off during printing, causing either excess ink or no ink to be transferred.

Conventional preparation of non-digital flexographic printing plates follows a similar process except that the integral mask is replaced by a separate film mask or "phototool" that is imaged separately and placed in contact with the flexographic printing precursor under a vacuum frame for the image-forming UV exposure.

A solution to overcome the highlight problem noted above is to establish a minimum halftone dot size during printing. This minimum halftone dot size must be large enough to survive processing and be able to withstand printing pressure. Once this ideal halftone dot size is determined, a "bump" curve can be created that increases the size of the lower halftone dot values to the minimum halftone dot setting. However, this results in a loss of the dynamic range and detail in the highlight and shadow areas. Overall, there is less tonality and detail in the image.

Thus, it is well known that there is a limit to the minimum size of halftone dots that can be reliably represented on a flexographic printing member and subsequently printed onto a receiver element. The actual minimum size will vary with a variety of factors including printing flexographic printing member type, ink used for printing, and imaging device characteristics among other factors including the particular printing press that is used. This creates a problem in the highlight areas when using conventional AM screening since once the minimum halftone dot size is reached, further size reductions will generally have unpredictable results. If, for example, the minimum size halftone dot that can be printed is a 50×50 μm square dot, corresponding to a 5% tone at 114 lines per inch screen frequency, then it becomes very difficult to faithfully reproduce tones between 0% and 5%. A common design around this problem is to increase the highlight values in the original file to ensure that after imaging and processing, all the tonal values in the file are reproduced as printing dots and are properly formed on the printing member. However, a disadvantage of this practice is the resulting additional dot gain in the highlights that causes a noticeable transition between inked and non-inked areas.

Another known practical way of improving highlights is through the use of "Respi" or "double dot" screening. One such technique is illustrated in FIGS. 1-A to 1-C. Screening grid 10 for a conventional AM screen is shown in a simplified schematic format and comprises a plurality of halftone cells 12. A halftone cell is an area wherein a printed AM halftone dot is grown from a low density, where only a small dot is placed at the center of the cell, to a high density or solid where the cell is completely filled. In FIG. 1-A, dots 14 are placed only in every second halftone cell and have a size corresponding to the minimum reliably reproducible dot. As the density of the screen is increased, the dots 16 are increased in size as shown in FIG. 1-B. At some point in increasing the density, the previously empty halftone cells are populated with minimum size dots 18 as shown in FIG. 1-C. Dots 16 may be held at a fixed size with increasing screen density while allowing dots 18 to grow. When all dots are the same size as dots 16, conventional AM screening takes over.

The problem with this type of screening technique, when applied to flexographic printing, is that the size of halftone dot that may be printed in isolation is actually quite large, typically 40-50 μm in diameter. Even when using this technique, the highlights are difficult to reproduce without having a grainy appearance, which occurs when halftone dots are spaced far apart to represent a very low density, and the printed halftone dot may also suffer an undesirable dot gain.

U.S. Pat. No. 7,486,420 (McCrea et al.) discloses a flexographic screening technique that compensates for characteristic printing problems in highlight areas by selectively placing non-printing dots or pixels proximate to highlight dots. The non-printing dots or pixels raise the printing relief floor in the highlight areas providing additional support for marginally printable image features. This technique allows an image feature to be surrounded by one or more smaller non-printing features to provide an extra base of support for the image feature. While this provides an important advance in the art, it may not always completely eliminate the grainy appearance in the image.

MAXTONE screening (Eastman Kodak Company) is a known hybrid AM screening solution that overcomes some highlight and shadow reproduction limitations. MAXTONE screening software allows the operator to set a minimum dot size in order to prevent the formation of halftone dots that are too small for the flexographic medium. To extend the tonal range, MAXTONE screening software uses an FM-like screening technique in the highlights and shadows. To create lighter shades, dots are removed in a random pattern. By producing lighter colors with fewer (rather than smaller) halftone dots, improved highlight detail and a more robust flexographic printing plate are achieved. However, completely removing dots from a highlight will necessarily reduce the resolution and edge fidelity of the resulting printed images.

U.S. Pat. Nos. 5,892,588 and 6,445,465 (both Samworth) describe an apparatus and method for producing a halftone screen having a plurality of halftone dots arrayed along a desired screen frequency by deleting a number of halftone dots per unit area to obtain gray shades below a predetermined shade of gray.

A Feb. 1, 2010 publication by the Association of Japanese Flexo Printing Industry entitled "Direct Laser Plate Making Consideration for Current Status" describes the use of undercutting in preparing flexographic printing plates to release the printing pressure in the highlight areas. FIG. 7 in this publication shows a progressive and predetermined undercutting in the relief image.

It is known to undercut certain dots as shown in FIGS. 2*a* to 2*c* wherein line 30 represents the top surface of the flexographic printing member coincident with the top surface of a solid or border 100. Dots 50 represent highlight dots in highlight areas. Line 20 represents the floor of the relief image, or the lowest plane of the engraved printing member and the depth between 30 and 20 is called the relief. Base 60 supports the floor and can be composed of various materials or composites including a rubber, woven cloth, or a polymer support. In FIG. 2*a*, none of highlight dots 50 is undercut and all of highlight dots 50 are printable. In FIGS. 2*a*-2*c*, the walls of the dots (for example, dots 50) are schematically represented as vertical. However, it is known that the actual dots can have sloped walls or walls with varying slopes or combinations of slopes and plateau regions between the top surface of the halftone dot and the floor. FIG. 2*b* shows an example of a prior art printing surface wherein all highlight dots 50 are equally undercut by amount 40. This commonly occurs due to exposure and process conditions in digital UV processed flexographic plates and extreme undercutting is undesirable because the undercut depth will exceed the lowest plane 49 that will transfer ink on press and will have no ink density on the printed receiver. FIG. 2*c* shows an example of the prior art where non-printing dots 70, having top surfaces below lowest plane 49 are intentionally added to raise the printing relief floor above line 20 in the highlight areas, providing additional support for marginally printable image features. This technique, however, provides only marginal improvement in highlight fidelity.

U.S. Pat. No. 6,984,478 (Dreber et al.) describes print control for flexographic printing by using a print control element.

Despite all of the progress made in flexographic printing to improve image quality in the highlight areas, there remains a need to improve the representation of small halftone dots in printed flexographic images so that image detail is improved and dot gain is reduced.

SUMMARY OF THE INVENTION

The present invention provides a method for providing a relief image in a flexographic printing member that can be used to transfer ink from an image area of the relief image to a corresponding image area of a receiver element, comprises:

removing elastomeric material from an elastomeric composition that has an elastomeric topmost surface, to provide a relief image comprising an image area in the elastomeric topmost surface, wherein the removing of elastomeric material provides a plurality of dots within a sub-area of the elastomeric topmost surface, each dot having a minimum receiver element contact area, so that a fraction less than 1 of the plurality of dots, known as (b) dots, within the sub-area have a topmost surface that is below the elastomeric topmost surface, the (b) dots being undercut below the elastomeric topmost surface in a predetermined number and arrangement so that the (b) dots are still able to transfer ink to the receiver element, and so that the remainder of the plurality of dots in the sub-area, known as (a) dots have a topmost surface that is essentially coincident with the elastomeric topmost surface, thereby providing a flexographic printing member with a relief image that has an image area.

This method can also comprise the further step of printing a halftone image with the flexographic printing member on a receiver element to obtain gray shades or ink densities below a predetermined shade of gray or ink density in a sub-area of the receiver element corresponding to the sub-area of the flexographic printing member.

The present invention provides improved flexographic printing members using a flexographic screening method that combines AM and FM screening with engagement modulation (EM) through control of undercutting of predetermined halftone dots in an image area of a relief image, to improve highlights with minimal loss of resolution or edge definition. On press, the gap between the elastomeric topmost surface of the flexographic printing member and a receiver element is adjusted to optimize print density. This gap is referred to as the engagement and creates the inking pressure (also known as "impression pressure") between the flexographic printing member and the receiver element to be printed. There is another gap controlled separately on press between the surface of the topmost surface of the flexographic printing member and the Anilox roller used to ink the plate, also referred to as engagement. To extend the tonal range, a plurality of flexographic printing member dots [(b) dots] representing a highlight are undercut to different depths below the elastomeric topmost surface with either a random, pseudorandom, or a predetermined pattern. For example, two or more different depths of undercutting can be selected from a range of depths greater than zero (no undercutting) to a maximum undercutting depth ($U_{max}$) to reproduce a given highlight level on the printed receiver sheet. In any given sub-area of the printing plate representing a highlight, at least a small fraction of the dots [(a) dots] in the sub-area are not purposely undercut in order to provide a local topmost surface that is essentially coincident with the topmost surface of the printing plate to control the local pressure with a given engagement, thus relieving pressure on the local undercut dots and facilitating local engagement modulation.

In some embodiments, many different depths of undercutting are used in a plurality of halftone dots in a sub-area of the elastomeric topmost surface, representing a highlight. $U_{max}$ is determined by the maximum undercut depth that leaves the halftone dot with a non-zero probability to transfer ink to a receiver element on press with a given set of inking and press conditions. $U_{max}$ depends upon many factors including the engagement setting of the printing plate and the Anilox cylinders on the printing press. By modulating the depth of the undercutting in a selected plurality of dots, the engagement and therefore the inking pressure and printing pressure are modulated dot to dot. A minimum dot size, $S_{min}$, (defined below) is selected in order to prevent the formation of halftone dots that are too small to achieve the purpose of this invention.

The flexographic printing members described herein can be prepared by a number of methods including direct engraving whereby a computer directs and modulates high powered and tightly focused laser beams to the flexographic printing precursor elastomeric surface, thus heating and ablating the elastomeric composition in a controlled manner, thereby controlling of the surface topology (formation of relief image) of the imaged flexographic printing member. The flexographic printing members, however, need not be produced only by that method.

BRIEF DESCRIPTION OF THE DRAWINGS

FIGS. 1-A to 1-C are schematic diagrams illustrating a prior art screening method wherein FIG. 1-A shows printed dots having minimum size placed only in every second halftone cell, FIG. 1-B showing the same placement but with larger printed dots, and FIG. 1-C showing a population of both sizes of printed dots.

FIGS. 2*a* to 2*c* are schematic cross-sectional diagrams also of prior art relief images wherein FIG. 2*a* shows no undercutting, FIG. 2*b* shows uniform undercutting, and FIG. 2*c* shows the presence of non-printing halftone dots to raise the relief image floor.

FIG. 3*a* is a schematic diagram of a tile-based screening method based on a non-repeating random undercut pattern.

FIG. 3*b* is a schematic diagram of a tile-based screening method based on a repeating random undercut pattern.

DETAILED DESCRIPTION OF THE INVENTION

Definitions

Figure 2A:
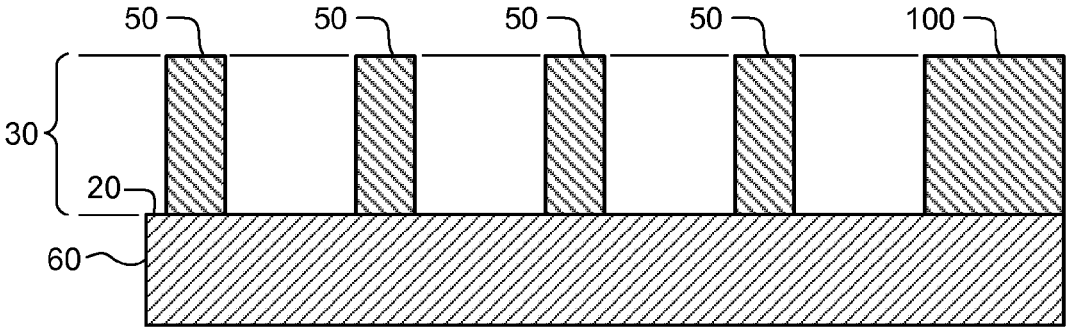
Figure 2B:
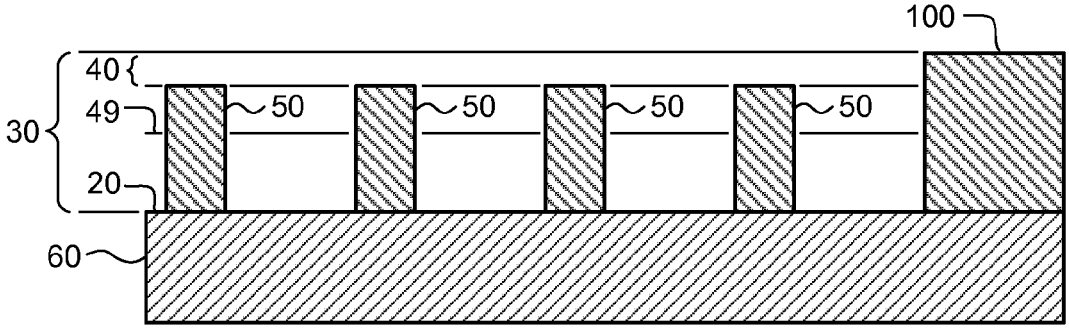
Figure 2C:
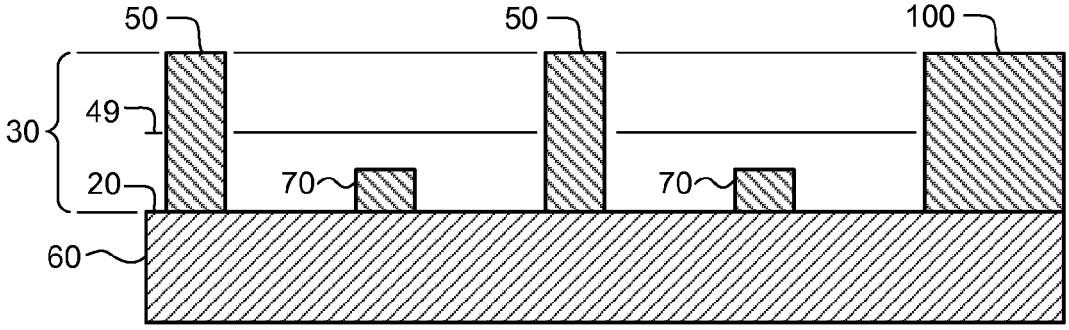

The following definitions identify various terms and phrases used in this disclosure to define the present invention. Unless otherwise noted, these definitions are meant to exclude other definitions of the terms or phrases that may be found in the prior art.

The term "flexographic printing precursor" refers to the article that is used to prepare a flexographic printing member and can be in the form of flexographic printing plate precursors, flexographic printing cylinder precursors, and flexographic printing sleeve precursors.

The term "flexographic printing member" refers to articles that are imaged flexographic printing precursors and can be in the form of a printing plate having a substantially planar elastomeric topmost surface, or a printing cylinder or seamless printing sleeve having a curved elastomeric topmost surface.

The term "receiver element" refers to any material or substrate that can be printed with ink using a flexographic printing member.

The term "ablative" relates to a composition or layer that can be imaged using a radiation source (such as a laser) that produces heat within the layer that causes rapid local changes in the composition or layer so that the imaged regions are physically detached from the rest of the composition or layer and ejected from the composition or layer.

"Ablation imaging" is also known as "ablation engraving" or "laser engraving".

The "elastomeric topmost surface" refers to the outermost surface of the elastomeric composition or layer in which a relief image is formed and is the first surface that is struck by imaging radiation.

The term "relief image" refers to all of the topographical features of the flexographic printing member provided by imaging and designed to transfer a pattern of ink to a receiver element.

The term "image area" refers to a predetermined area of the relief image in the elastomeric composition, which predetermined area is designed to be inked and to provide a corresponding inked image area on a receiver element.

The term "sub-area" refers to a portion of the image area that corresponds to an area on the printed receiver element having a particular desired ink density or gray scale. The sub-area can be further divided into collections of dots, which collections can also be referred to as "tiles".

The term "relief image floor" refers to the bottom-most surface of the relief image. For example, the floor can be considered the maximum depth of the relief image from the elastomeric topmost surface and can range from 100 to 1000 μm. The relief image generally includes "valleys" that are not inked and that have a depth from the elastomeric topmost surface that is less than the maximum depth.

As used herein, the term "dot" refers to a formed protrusion or microstructure in the relief image formed in the flexographic printing member of this invention. Some publications refer to this dot as a "halftone dot". The term "dot" does not refer to the dot-like printed image on a receiver element that is provided by the dot on the flexographic printing member. However, it is desired that the dot on the flexographic printing member would correspond as closely as possible to the dot-like image printed on a receiver element. Each dot in the sub-area of the elastomeric topmost surface has a "minimum receiver element contact area", which means that when the dot is inked and contacted with a receiver element, the inked dot-like image area printed on the receiver element has a minimum contact area that is determined by many factors including the minimum spot size of the laser beams used to engrave the relief image in the flexographic printing member. A current estimate for the minimum spot size given the best engraving systems currently available would be approximately 30 μm by 30 μm or 900 $\mu m^2$, but larger minimum receiver element contact areas could be needed for a particular imaging system and smaller minimum receiver element contact areas could become feasible as system resolution improves.

Two types of dots are contemplated for the sub-area of the elastomeric topmost surface, defined herein as (a) dots and (b) dots. The (a) dots are not purposely undercut and have a topmost surface that is essentially coincident with the elastomeric topmost surface, that is, they help form the topmost surface of the relief image that can transfer ink. By "essentially coincident", we mean the difference between the elastomeric topmost surface and the top surface of the (a) dots is no more than about 10 μm. The (b) dots are undercut so that they have topmost surfaces that are located below the elastomeric topmost surface a discernable depth, for example at least 10 μm or typically at least 20 μm. However, it is desired that the (b) dots be undercut in a manner and to an extent so that they are still able to transfer ink to a receiver element.

A "non-printing dot" is one that is undercut sufficiently that applied ink is not transferred to a receiver element in the printing operation.

As used herein, the terms "undercut" and "undercutting" refer to the depth a (b) dot is recessed below the topmost elastomeric surface of the flexographic printing member.

The term "natural undercut" refers to a dot or microstructure having a topmost surface that is undercut below the elastomeric topmost surface only by virtue of the system used to produce the relief image and not due to intentionally added undercut. For example, all small dots on the order of 20 μm to 30 μm in diameter are typically undercut by at least 10 μm when produced by a direct engraving system with focused laser spots larger than 40 μm.

The term "highlight" refers to a sub-area of the flexographic printing plate corresponding to low density or light gray scale in a corresponding printing area on a printed receiver element. It can also refer to the printed low density area on a receiver element, depending upon the specific context of the use of the term.

Flexographic Printing Members

The amount of the undercut for each (b) dot can be controlled by laser ablation in direct engraving systems or by special masking and careful exposure and printing member processing of a conventional UV imaged photosensitive plates or digitally written UV sensitive flexographic printing member. The top surface of each (b) dot can be essentially flat or curved, or there can be a mixture of (b) dots with flat and curved top surfaces. The plurality of dots in the sub-area can have some (b) dots with a flat topmost surface and some (b) dots with a curved top surface, or some other (b) dots with yet a different topmost shape. At least some of the walls of the (b) dots can be vertical (perpendicular to the relief floor), or at least one (b) dot has wall angles, with respect to the elastomeric topmost surface, as viewed in cross-section, that are not perpendicular to the relief image floor, that is the wall is sloped at a desired angle (not perpendicular to the relief floor), as viewed in cross-section. This can be true of either (a) dots or (b) dots, or both (a) and (b) dots. For example, either or both of the (a) and (b) dots can have angled walls that are not perpendicular to the relief floor. The walls of the (b) dots can have a distribution of slopes and can also have plateaus below the printing surface of the halftone dot. The cross-sectional shape of the (b) dots as viewed from the top of the flexographic printing member need not be uniform for all (b) dots. For example, the (b) dots can be rounded, square, rectangular, diamond, L-shaped, t-shaped, ring-shaped, or any combination of these shapes. These dots can have multiple shapes, sizes, geometric patterns, or variable surfaces, in the same or different (b) dot. The topmost shape is not limited and can be varied as much as the user wants.

In one embodiment of the invention, all of the (b) dots in the sub-area are constructed to have the same size, $S_{min}$. In another embodiment of the invention, at least some (b) dots are made with a size equal to or greater than $S_{min}$.

In the flexographic printing members prepared using this invention, the (b) dots can have topmost surfaces that are at least 10 μm and up to and including 200 μm, or at least 20 μm and up to and including 75 μm, below the elastomeric topmost surface of the image area. These numbers refer to the undercut depth.

The fraction of the plurality of (b) dots is at least 0.1 and less than 1, or more likely, up to 0.98, or at least 0.25 but less than or equal to 0.9.

In some embodiments, all of the (b) dots in the flexographic printing member have topmost surfaces that are the essentially same depth below the elastomeric topmost surface.

In other embodiments, all of the (b) dots have topmost surfaces that are below the elastomeric topmost surface by two or more different depths, and the number of undercut depths is limited only by constraints of the imaging system.

For example, the flexographic printing member can have all of its (b) dots with topmost surfaces that are below the elastomeric topmost surface by the same or different depths in a predetermined arrangement.

Thus, the flexographic printing member can have (b) dots that have topmost surfaces that are below the elastomeric topmost surface by the same or different depths in a predetermined amount sufficient to provide a desired average print density within a corresponding unit area of the receiver element.

Alternatively, the flexographic printing member has a relief image that has a geometric feature, and the (a) dots and (b) dots are arranged in a predetermined fashion to form the geometric feature or shape that is desired for the eventual printed image in a receiver element.

In another embodiment of the invention, the distribution of undercut depths from the elastomeric topmost surface for the (b) dots within the sub-area is constructed such that deep and shallow undercut (b) dots do not bunch or cluster together.

For a given sub-area of the elastomeric topmost surface, the distribution of undercut depths is selected to give a print density in the eventual printed image on the receiver element that is close to the desired optical density. This can be achieved by any means including use of a lookup table or an algorithm that includes a weighted random number generator. The selection process for determining the distribution of undercut depths from the elastomeric topmost surface can include addition filters or weighting factors that take into account the proximity of (a) and (b) dots to other features in an image besides halftones such as for example block solids, text, lines, borders, frames, vignettes, or blank spaces.

The flexographic printing members prepared using the present invention can be flexographic printing plates having any suitable shape, flexographic printing cylinders, or seamless sleeves that are slipped onto printing cylinders.

Elastomeric compositions used to prepare useful flexographic printing precursors are described in numerous publications including, but not limited to, U.S. Pat. No. 5,719,009 (Fan), U.S. Pat. No. 5,798,202 (Cushner et al.), U.S. Pat. No. 5,804,353 (Cushner et al.), and WO 2005/084959 (Figov), all of which are incorporated herein by reference with respect to their teaching of photosensitive materials and construction of flexographic printing precursors. In general, the elastomeric composition comprises a crosslinked elastomer or a vulcanized rubber.

DuPont's Cyrel® FAST™ thermal mass transfer plates are commercially available photosensitive resin flexographic printing plate precursors that comprise an integrated ablatable mask element and require minimal chemical processing. These elements can be used as flexographic printing precursors in the practice of this invention.

For example, flexographic printing precursors can include a self-supporting laser-ablatable or engraveable, relief-forming layer (defined below) containing an elastomeric composition that forms a rubber or elastomeric layer. This layer does not need a separate substrate to have physical integrity and strength. In such embodiments, the laser-ablatable, relief-forming layer composed of the elastomeric composition is thick enough and laser ablation is controlled in such a manner that the relief image depth is less than the entire thickness, for example up to 80% of the entire thickness of the layer.

However, in other embodiments, the flexographic printing precursors include a suitable dimensionally stable, non-laser engraveable substrate having an imaging side and a non-imaging side. The substrate has at least one laser engraveable, relief-forming layer (formed of the elastomeric composition) disposed on the imaging side. Suitable substrates include but are not limited to, dimensionally stable polymeric films, aluminum sheets or cylinders, transparent foams, ceramics, fabrics, or laminates of polymeric films (from condensation or addition polymers) and metal sheets such as a laminate of a polyester and aluminum sheet or polyester/polyamide laminates, or a laminate of a polyester film and a compliant or adhesive support. Polyester, polycarbonate, vinyl polymer, and polystyrene films are typically used. Useful polyesters include but are not limited to poly(ethylene terephthalate) and poly(ethylene naphthalate). The substrates can have any suitable thickness, but generally they are at least 0.01 mm or from about 0.05 to about 0.3 mm thick, especially for the polymeric substrates. An adhesive layer may be used to secure the elastomeric composition to the substrate.

There may be a non-laser ablatable backcoat on the non-imaging side of the substrate (if present) that may be composed of a soft rubber or foam, or other compliant layer. This backcoat may be present to provide adhesion between the substrate and the printing press rollers and to provide extra compliance to the resulting printing member, or to reduce or control the curl of the printing member.

Thus, the flexographic printing precursor contains one or more layers. Besides the laser-engraveable, relief-forming layer, there may be a non-laser ablatable elastomeric rubber layer (for example, a cushioning layer) between the substrate and the topmost elastomeric composition forming the laser-engraveable relief-forming layer.

In general, the laser-engraveable, relief-forming layer composed of the elastomeric composition has a thickness of at least 50 μm and generally from about 50 to about 4,000 μm, or typically from 200 to 2,000 μm.

The elastomeric composition includes one or more laser-ablatable polymeric binders such as crosslinked elastomers or rubbery resins such as vulcanized rubbers. For example, the elastomeric composition can include one or more thermosetting or thermoplastic urethane resins that are derived from the reaction of a polyol (such as polymeric diol or triol) with a polyisocyanate, or the reaction of a polyamine with a polyisocyanate. In other embodiments, the elastomeric composition contains a thermoplastic elastomer and a thermally initiated reaction product of a multifunctional monomer or oligomer.

Other elastomeric resins include copolymers or styrene and butadiene, copolymers of isoprene and styrene, styrene-butadiene-styrene block copolymers, styrene-isoprene-styrene copolymers, other polybutadiene or polyisoprene elastomers, nitrile elastomers, polychloroprene, polyisobutylene and other butyl elastomers, any elastomers containing chlorosulfonated polyethylene, polysulfide, polyalkylene oxides, or polyphosphazenes, elastomeric polymers of (meth)acrylates, elastomeric polyesters, and other similar polymers known in the art.

Still other useful laser-engraveable resins include vulcanized rubbers, such as EPDM (ethylene-propylene diene rubber), Nitrile (Buna-N), Natural rubber, Neoprene or chloroprene rubber, silicone rubber, fluorocarbon rubber, fluorosilicone rubber, SBR (styrene-butadiene rubber), NBR (acrylonitrile-butadiene rubber), ethylene-propylene rubber, and butyl rubber.

Still other useful laser-engraveable resins are polymeric materials that, upon heating to 300° C. (generally under nitrogen) at a rate of 10° C./minute, lose at least 60% (typically at least 90%) of their mass and form identifiable low molecular weight products that usually have a molecular weight of 200 or less. Specific examples of such laser engraveable materials include but are not limited to, poly(cyanoacrylate)s that include recurring units derived from at least one alkyl-2-cyanoacrylate monomer and that forms such monomer as the predominant low molecular weight product during ablation. These polymers can be homopolymers of a single cyanoacrylate monomer or copolymers derived from one or more different cyanoacrylate monomers, and optionally other ethylenically unsaturated polymerizable monomers such as (meth) acrylate, (meth)acrylamides, vinyl ethers, butadienes, (meth) acrylic acid, vinyl pyridine, vinyl phosphonic acid, vinyl sulfonic acid, and styrene and styrene derivatives (such as α-methylstyrene), as long as the non-cyanoacrylate comonomers do not inhibit the ablation process. The monomers used to provide these polymers can be alkyl cyanoacrylates, alkoxy cyanoacrylates, and alkoxyalkyl cyanoacrylates. Representative examples of poly(cyanoacrylates) include but are not limited to poly(alkyl cyanoacrylates) and poly(alkoxyalkyl cyanoacrylates) such as poly(methyl-2-cyanoacrylate), poly (ethyl-2-cyanoacrylate), poly(methoxyethyl-2-cyanoacrylate), poly(ethoxyethyl-2-cyanoacylate), poly(methyl-2-cyanoacrylate-co-ethyl-2-cyanoacrylate), and other polymers described in U.S. Pat. No. 5,998,088 (Robello et al.)

In still other embodiments, the laser-engraveable elastomeric composition can include an alkyl-substituted polycarbonate or polycarbonate block copolymer that forms a cyclic alkylene carbonate as the predominant low molecular weight product during depolymerization from engraving. The polycarbonate can be amorphous or crystalline, and can be obtained from a number of commercial sources including Aldrich Chemical Company (Milwaukee, Wis.). Representative polycarbonates are described for example in U.S. Pat. No. 5,156,938 (Foley et al.), Cols. 9-12 of which are incorporated herein by reference. These polymers can be obtained from various commercial sources or prepared using known synthetic methods.

In still other embodiments, the laser-engraveable polymeric binder is a polycarbonate (tBOC type) that forms a diol and diene as the predominant low molecular weight products from depolymerization during laser-engraving.

The laser-engraveable elastomeric composition generally comprises at least 10 weight % and up to 99 weight %, and typically from about 30 to about 80 weight %, of the laser-engraveable elastomers or vulcanized rubbers.

In some embodiments, inert microcapsules are dispersed within laser-engraveable polymeric binders. For example, microcapsules can be dispersed within polymers or polymeric binders, or within the crosslinked elastomers or rubbery resins. The "microcapsules" can also be known as "hollow beads", "microspheres", "microbubbles", "microballoons", "porous beads", or "porous particles". Such components generally include a thermoplastic polymeric outer shell and either core of air or a volatile liquid such as isopentane and isobutane. These microcapsules can include a single center core or many interconnected or non-connected voids within the core. For example, microcapsules can be designed like those described in U.S. Pat. No. 4,060,032 (Evans) and U.S. Pat. No. 6,989,220 (Kanga), or as plastic micro-balloons as described for example in U.S. Pat. No. 6,090,529 (Gelbart) and U.S. Pat. No. 6,159,659 (Gelbart).

The laser-engraveable, relief-forming layer composed of the elastomeric composition can also include one or more infrared radiation absorbing compounds that absorb IR radiation in the range of from about 750 to about 1400 nm or typically from 750 to 1250 nm, and transfer the exposing photons into thermal energy. Particularly useful infrared radiation absorbing compounds are responsive to exposure from IR lasers. Mixtures of the same or different type of infrared radiation absorbing compound can be used if desired. A wide range of infrared radiation absorbing compounds are useful in the present invention, including carbon blacks and other IR-absorbing organic or inorganic pigments (including squarylium, cyanine, merocyanine, indolizine, pyrylium, metal phthalocyanines, and metal dithiolene pigments), iron oxides and other metal oxides.

Additional useful IR radiation absorbing compounds include carbon blacks that are surface-functionalized with solubilizing groups are well known in the art. Carbon blacks that are grafted to hydrophilic, nonionic polymers, such as FX-GE-003 (manufactured by Nippon Shokubai), or which are surface-functionalized with anionic groups, such as CAB-O-JET® 200 or CAB-O-JET® 300 (manufactured by the Cabot Corporation) are also useful. Other useful pigments include, but are not limited to, Heliogen Green, Nigrosine Base, iron (III) oxides, transparent iron oxides, magnetic pigments, manganese oxide, Prussian Blue, and Paris Blue. Other useful IR radiation absorbing compounds are carbon nanotubes, such as single- and multi-walled carbon nanotubes, graphite, grapheme, and porous graphite.

Other useful infrared radiation absorbing compounds (such as IR dyes) are described in U.S. Pat. No. 4,912,083 (Chapman et al.), U.S. Pat. No. 4,942,141 (DeBoer et al.), U.S. Pat. No. 4,948,776 (Evans et al.), U.S. Pat. No. 4,948,777 (Evans et al.), U.S. Pat. No. 4,948,778 (DeBoer), U.S. Pat. No. 4,950,639 (DeBoer et al.), U.S. Pat. No. 4,950,640 (Evans et al.), U.S. Pat. No. 4,952,552 (Chapman et al.), U.S. Pat. No. 4,973,572 (DeBoer), U.S. Pat. No. 5,036,040 (Chapman et al.), and U.S. Pat. No. 5,166,024 (Bugner et al.).

Optional addenda in the laser-engraveable elastomeric composition can include but are not limited to, plasticizers, dyes, fillers, antioxidants, antiozonants, stabilizers, dispersing aids, surfactants, dyes or colorants for color control, and adhesion promoters, as long as they do not interfere with engraving efficiency.

The flexographic printing precursor can be formed from a formulation comprising a coating solvent, one or more elastomeric resins, and an infrared radiation absorbing compound, to provide an elastomeric composition. This formulation can be formed as a self-supporting layer or applied to a suitable substrate. Such layers can be formed in any suitable fashion, for example by injecting, spraying, or pouring a series of formulations to the substrate. Alternatively, the formulations can be press-molded, injection-molded, melt extruded, co-extruded, or melt calendared into an appropriate layer or ring (sleeve) and optionally adhered or laminated to a substrate and cured to form a layer, flat or curved sheet, or seamless printing sleeve. The flexographic printing precursors in sheet-form can be wrapped around a printing cylinder and fused at the edges to form a seamless printing precursor.

Method of Forming Flexographic Printing Member

Imaging of the flexographic printing precursor to provide the desired relief image, including the desired undercut (b) dots can be achieved using any suitable technique and apparatus for engraving, including but not limited to, direct laser engraving using one or more laser diodes (for example infrared laser diodes). The flexographic printing member can have a relief image with a geometric feature, or it can have a relief image that is irregular in shape or appearance.

Generally, the method of this invention is carried out so that the fraction of undercut halftone dots per unit area is at least 0.1 but less than 0.98 (or at least 0.25 and up to and including 0.9) so that the unit area has some (a) dots that are not purposely undercut. The (a) dots in the unit area that are not undercut can be uniformly distributed within the sub-area or distributed in a random fashion.

Using the teaching provided herein, a skilled worker in the art can undercut the fraction of (b) dots in the sub-area in a manner to provide a desired average print density within the corresponding unit area in the receiver element.

The present invention includes, but is not limited to, the following features that can be used alone or in any suitable combination of with one or more other features:

1) The probability of a given undercut depth for each (b) dot is set such that, on average, a sub-area containing a large number of (b) dots generated with this distribution will print to provide the desired average density on a receiver element.

2) At least one (a) dot is present in the sub-area, which (a) dot is not purposely undercut.

3) In some embodiments, several (a) dots are uniformly distributed within the sub-area.

4) Certain (b) dots within the plurality of dots in the sub-area can be designed to provide a uniform tint value in a printed image as they are assigned a fixed undercut depth according to their position in the sub-area such that the collection of (a) and (b) dots in the sub-area have a randomized distribution of undercut depths within a predetermined range of undercut depths but the collection of (a) and (b) dots has a fixed relative spatial orientation (that is, repeating pattern) within the plurality of dots.

5) As noted above, the angle of the (b) dot walls as viewed in cross-section need not be perpendicular to the floor, and the top surfaces of the (b) dots can be flat or parallel to the elastomeric topmost surface.

6) The topmost surfaces of the (b) dots can have a rounded profile as viewed in cross section. When the (b) dots have a rounded profile, the more deeply undercut (b) dots will print with less contact area to a receiver element than other (b) dots having the same cross section area but that are less deeply undercut.

7) In some embodiments, the randomized distribution of undercut (b) dots can be combined with area modulation as long as some (b) dots in the tint have an area at least equivalent to $S_{min}$.

8) In still other embodiments, the probability for assigning the undercut depth for the (b) dots can be modified by proximity to other features in the image such as solids, lines, borders, or text, or combinations of these features. For example, the undercut depth can be reduced for (b) dots adjacent to or in the proximity of a solid patch or frames.

An embodiment of a distribution useful in the practice of this invention is shown in FIG. 3*a* that represents a distribution of undercut depths (in μm). In this embodiment, the undercut pattern within the repeating tiles differs from tile to tile within the highlight (sub-area). For example, the tile contains a square 4×4 array of dots. Moreover, each tile contains an (a) dot with zero undercutting. It is recognized that some undercutting may be unavoidable when constructing small dots at maximum resolution. It is possible to use (a) dots with minimal or no undercutting, which (a) dots can be distributed uniformly among the (b) dots within the sub-area of the image area. In this embodiment, the amount of undercutting of each (b) dot within a tile is greater than 10 μm and up to and including 57 μm and is chosen pseudo-randomly. Some bunching in the distribution of shallow and deep (b) dots can occur due to the random selection process within each tile.

Another embodiment of this invention is shown in FIG. 3*b* that represents a distribution of undercut depths (in μm). An array of tiles consisting of a specific pattern of 4×4 dots having different undercut (b) dots is repeated to form a highlight sub-area. In this embodiment, the amount of undercutting of each (b) dot within a tile ranges from greater than 10 μm and up to and including 57 μm and the tile is repeated over the sub-area of the highlight. This results in a more uniform distribution of (b) dots with deep and shallow undercut depths.

For all embodiments of this invention, it is understood that the depth of undercut for each (b) dot can have any value in the acceptable range between 0 and the maximum undercut depth (noted above), which has a non-zero capability of transferring ink to a printable receiver element. At least two different undercut depths can be used for a given sub-area and these depths can be repeated within that sub-area. One of the undercut depths can be near zero as long as at least one other undercut depth is greater and in the range of acceptable undercut depths is also used. It is contemplated that a variation during printing on press may leave some of the maximally undercut (b) dots unable to transfer ink. However, it is desired to keep non-printing (b) dots to a minimum.

In yet another embodiment of this invention, the sub-area in the image area is not composed of tiles but contains a distribution of (b) dots where the undercut depth of each (b) dot is chosen randomly within the range of acceptable undercut depths.

Figure 4:
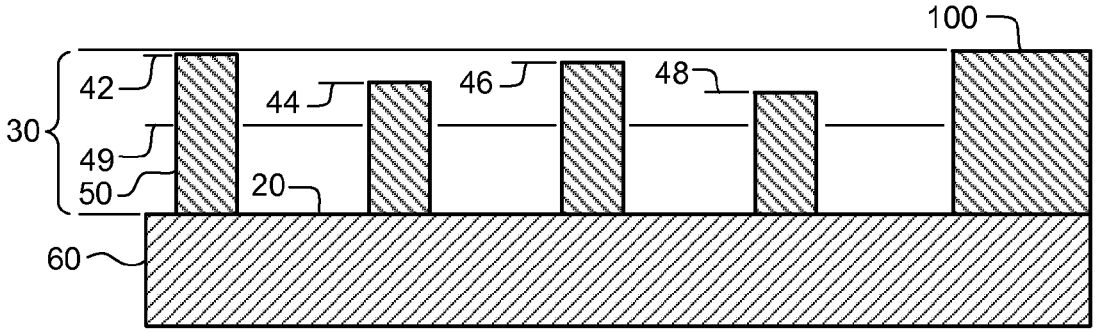
FIG. 4 is a schematic cross-sectional diagram of an embodiment of a screening method to provide a flexographic printing member having straight walled halftone dots.

A schematic cross-section of another embodiment is shown in FIG. 4. Line 30 represents the elastomeric topmost surface of the elastomeric composition in the flexographic printing member essentially coincident with the topmost surface of a solid or border 100. The minimum dot size, $S_{min}$, of (a) dot 50 comprises the smallest dots in the flexographic halftone image that are not too small for the flexographic printing member. Line 20 represents the relief image floor, the lowest plane of the imaged flexographic printing member and the depth between 30 and 20 is the relief image depth. Base layer 60 below the floor can include a suitable substrate of some type, such as a woven cloth and a polymeric film (other substrates described above). At least two different undercut depths are used within the sub-area chosen from the range of printable undercut depths. In this particular embodiment, the dots are undercut by 4 different depths shown by dots 42, 44, 46, and 48, ranging from minimally undercut (a) dot 42 to a maximally undercut (b) dot 48 that does not exceed the printable undercut depth limit 49. The minimally undercut depth can be near zero or less than 10 μm. The method of choosing the distribution of undercut depth for the (b) dots can be random or predetermined (selected) with a regular pattern. For example, the undercut depths are not completely random but chosen such that the minimally undercut (a) dots 42, maximally undercut (b) dots 48, and intermediate undercut (b) dots 44 and 46 are evenly distributed within the sub-area.

For example, the maximally undercut (b) dots 48 can be arranged adjacent to the minimally undercut (a) dot 42. Alternatively, the undercut depths of (b) dots are gradually diminished or decreased evenly from the minimally undercut (b) dots. In a particularly useful embodiment, the distribution of undercut depths of the (b) dots is chosen to give the smoothest appearance in eventual printed image in a receiver element.

Figure 8:
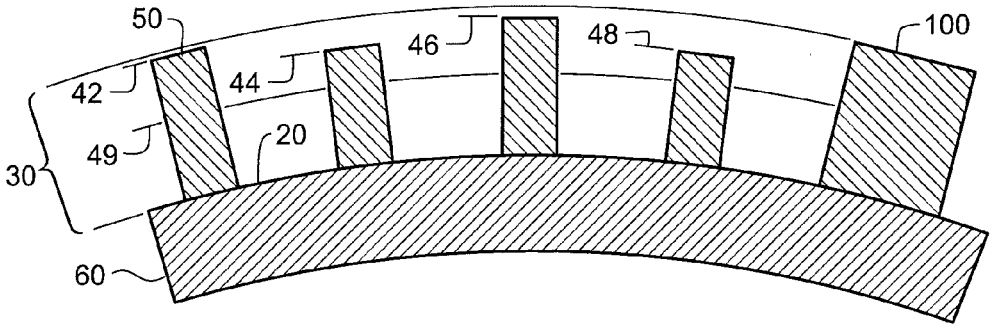
FIG. 8 is a schematic cross-sectional and partial view of another embodiment of this invention, which is a flexographic sleeve or cylinder having a curved elastomeric topmost surface.

FIG. 8 shows a schematic cross-sectional and partial view of an another embodiment of the present invention that is similar to FIG. 4, having components that are identified by the same reference numbers, but has a curved elastomeric topmost surface.

Figure 5:
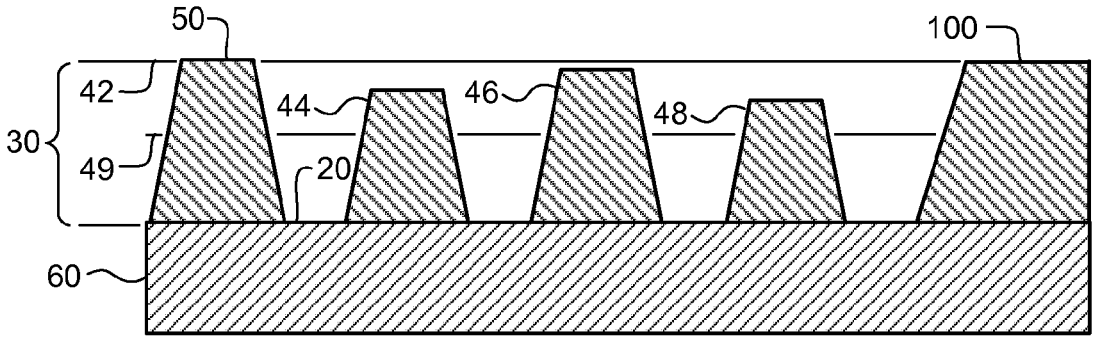
FIG. 5 is a schematic cross-sectional diagram of another embodiment of a screening method to provide a flexographic printing member having angled walled halftone dots.
Figure 6:
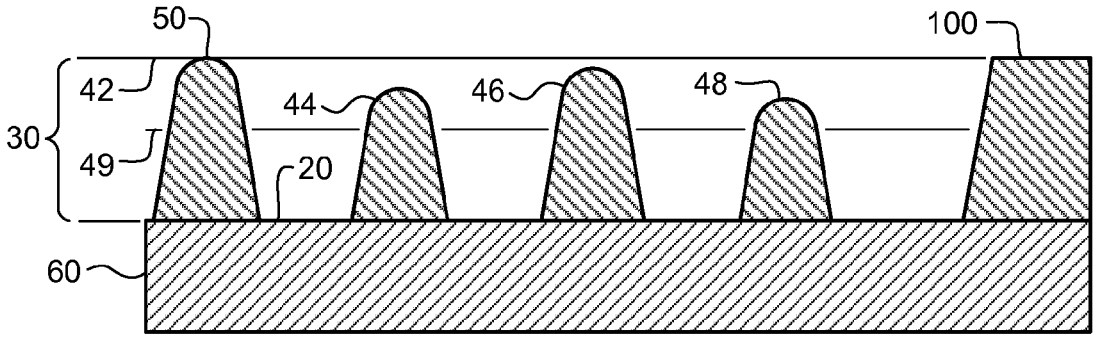
FIG. 6 is a schematic cross-sectional diagram of still another embodiment of a screening method to provide a flexographic printing member having rounded top halftone dots.
Figure 7:
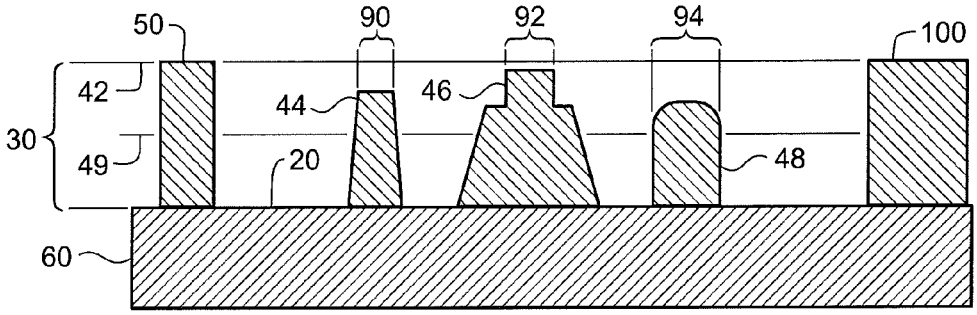
FIG. 7 is a schematic diagram of yet another embodiment of a screening method to provide a flexographic printing member having random variably undercut halftone dots with multiple geometric shapes and surfaces.

Both (a) and (b) dots can have sloped walls as shown schematically in FIG. 5, or they can have walls with a combination of many slopes and plateau regions between the topmost surface of the dots and the relief floor. Still another embodiment can have at least some of the (a) and (b) dots with rounded tops as shown schematically in FIG. 6. Moreover, (b) dots can also be prepared according to this invention with varying multiple surface areas or multiple geometric shapes as illustrated schematically in FIG. 7.

Ablation or engraving energy can be applied using a suitable laser such as a $CO_2$ or infrared radiation-emitting diode or YAG lasers, or array or such lasers. Ablation engraving is used to provide a relief image with a minimum floor depth of at least 100 μm or typically from 300 to 1000 μm. However, local minimum depths between halftone dots can be less. The relief image may have a maximum depth up to about 100% of the original thickness of the laser-engraveable, relief-forming layer when a substrate is present. In such instances, the floor of the relief image can be the substrate if the laser-engraveable, relief-forming layer is completely removed in the image area, a lower region of the laser-engraveable, relief-forming layer, or an underlayer such as an adhesive layer, compliant layer, or a non-ablative elastomeric or rubber underlayer. When a substrate is absent, the relief image can have a maximum depth of up to 80% of the original thickness of the laser-engraveable, relief-forming layer comprising the elastomeric composition. A laser operating at a wavelength of from about 700 nm to about 11 μm is generally used, and a laser operating at from 800 nm to 1250 nm is also useful. The laser must have a high enough intensity that the pulse or the effective pulse caused by relative movement is deposited approximately adiabatically during the pulse.

Generally, engraving is achieved using at least one infrared radiation laser having a minimum fluence level of at least 1 $J/cm^2$ at the elastomeric topmost surface and typically infrared imaging is at from about 20 to about 1000 $J/cm^2$ or from about 50 to about 800 $J/cm^2$.

Engraving a relief image can occur in various contexts. For example, sheet-like precursors can be imaged and used as desired, or wrapped around a printing cylinder or cylinder form before imaging. The flexographic printing precursor can also be a printing sleeve that can be imaged before or after mounting on a printing cylinder.

During imaging, most of the removed products of engraving are gaseous or volatile and readily collected by vacuum for disposal or chemical treatment. Any solid debris can be similarly collected using vacuum or washing.

After imaging, the resulting flexographic printing member can be subjected to an optional detacking step if the elastomeric topmost surface is still tacky, using methods known in the art.

During printing, the resulting flexographic printing member is inked using known methods and the ink is appropriately transferred to a suitable receiver element.

After printing, the flexographic printing member can be cleaned and reused and a printing cylinder can be scraped or otherwise cleaned and reused as needed.

A test was run using an imaging apparatus and flexographic printing plate precursor (direct engraving rubber precursor that was obtained from Bottcher, Belcamp, Md.) to determine the range of (b) dot undercut depths and the minimum dot surface area. The particular imaging apparatus used in this test can address 10 μm pixels but the spot size on the printing plate surface is larger than 10 μm. It is understood that the particular imaging apparatus and its laser characteristics will determine the minimum dot surface area that can be formed without resulting in non-purposeful undercutting. After direct engraving, the resulting flexographic printing plate contained two matrices of highlight sub-areas. In one matrix, each highlight sub-area was surrounded by a millimeter wide border and in the other matrix, each highlight sub-area directly abutted its neighbor and was therefore borderless. Highlights (predetermined sub-areas) were composed of square dots having 4, 9, 16, 25, 36, 49, 64, 81, and 100 pixels where a pixel was approximately 10 μm×10 μm, the walls of the dots were approximately 19 degrees from vertical, and the topmost surfaces of the printing plate dots were engraved with a series of undercuts depths of 0, 10, 20, 30, 40, 50, and 60 μm for each dot size. Each highlight sub-area was a square having approximately 1 cm sides. Thus each matrix contained 64 highlight sub-areas in a 9×7 grid.

In each highlight sub-area, all dots were undercut the same depth. The sub-areas did not contain a mixture of (a) and (b) dots and therefore, these tests represent a control or calibration experiment and are not meant to be examples of the present invention. The actual undercut depth was measured using profilometry and found to be a function of dot size. The smallest printing plate dots (4 pixels) having nominally zero undercut depth were actually undercut by about 35 μm due to an overlap of the engraving laser spots at the highest dot resolution. Successive undercuts were approximately given by the sum of their nominal undercut and the 35 μm offset. Printing plate dots having 9 pixels and nominally zero undercut were measured to have an undercut depth of about 10 μm. Printing plate dots having 25 pixels or more and nominally zero undercut were actually undercut by no more than a few micrometers. Therefore, actual undercut depths of the larger printing plate dots were close to their nominal values.

The flexographic printing plate was mounted on a conventional flexographic printing press and used to print a nonporous polymeric receiver element using a conventional cyan flexographic ink. The printed receiver element was inspected with a densitometer and under a microscope to determine the density of ink transfer and the quality for each condition. Both the density of ink and the quality of the printed dots were dependent on the size of the printing plate dot, the dot undercut depth, and the presence or absence of borders surrounding the highlights.

Addressing the borderless highlights first, the smallest printing plate dots (4 pixels=20 μm by 20 μm square dots) were reproduced on the printed sheet fairly uniformly with nominally zero undercut (actually 35 μm). With nominally 10

μm undercut depth, most but not all printing plate dots transferred ink to the printed receiver element and some smearing of ink was observed. At 20 μm undercut depth, fewer printing plate dots printed on the receiver element and more ink smearing was observed. With nominal 30 μm undercut depth, very few printing plate dots were observed to transfer ink and no printing plate dots printed with 40 μm undercut depth (75 μm actually). Thus, for this size dot and print conditions, the maximum undercut depth that allowed transfer of ink is between about 30 and 40 μm (or about 35+35=70 μm actual depth). Larger printing plate dots transferred at least some ink up to a nominal 60 μm undercut depth.

Addressing the highlights with borders, the smallest halftone dots were reproduced on the receiver element uniformly except for rows and columns of halftone dots immediately adjacent the borders where some halftone dots failed to transfer ink even with nominally zero undercut depth (actually 35 μm). As with the borderless prints, no 4 pixel dots transferred ink with nominal 40 μm undercut depth (actually 75 μm). The 9 pixel dots failed to transfer ink at nominal 50 μm (actually 60 μm) undercut depth under and larger dots transferred some ink at up to 60 μm undercut depth.

From these observations it was determined that, under the described engraving, printing press, and inking conditions, the 9 pixel dot was the smallest size that printed reliably having 10 μm of natural undercut depth that was essentially coincident with the elastomeric topmost surface of the flexographic printing plate. Therefore, a good choice for a minimum area was approximately $S_{min}$=900 $\mu m^2$ (that is 9 pixel=30 μm×30 μm) and a good choice for $U_{max}$ was approximately equal to 60 μm actual undercut depth.

The present invention provides at least the following embodiments and combinations thereof, but other combinations of features are considered to be within the present invention as a skilled artisan would appreciate from the teaching of this disclosure:

1. A method for providing a relief image in a flexographic printing member that can be used to transfer ink from an image area of the relief image to a corresponding image area of a receiver element, the method comprising:

removing elastomeric material from an elastomeric composition that has an elastomeric topmost surface, to provide a relief image comprising an image area in the elastomeric topmost surface, wherein the removing of elastomeric material provides a plurality of dots within a sub-area of the elastomeric topmost surface, each dot having a minimum receiver element contact area, so that a fraction less than 1 of the plurality of dots, known as (b) dots, within the sub-area have a topmost surface that is below the elastomeric topmost surface, the (b) dots being undercut below the elastomeric topmost surface in a predetermined number and arrangement so that the (b) dots are still able to transfer ink to the receiver element, and so that the remainder of the plurality of dots in the sub-area, known as (a) dots have a topmost surface that is essentially coincident with the elastomeric topmost surface, thereby providing a flexographic printing member with a relief image that has an image area.

2. The method of embodiment 1 wherein the elastomeric material is removed to provide the relief image in the image area using direct laser engraving.

3. The method of embodiment 1 or 2 wherein the elastomeric composition is provided on a non-laser engraveable substrate.

4. The method of any of embodiments 1 to 3 wherein the elastomeric composition comprises an elastomer, a crosslinked elastomer, or a vulcanized rubber.

5. The method of any of embodiments 1 to 4 that provides a substantially planar flexographic printing plate.

6. The method of any of embodiments 1 to 4 that provides a flexographic printing sleeve or cylinder with a curved elastomeric topmost surface.

7. The method of any of embodiments 1 to 6 comprising engraving all of the (b) dots so that they have topmost surfaces that are below the elastomeric topmost surface by essentially the same depth.

8. The method of any of embodiments 1 to 6 comprising engraving all of the (b) dots so that they have topmost surfaces that are below the elastomeric topmost surface by two or more different depths in a predetermined arrangement.

9. The method of any of embodiments 1 to 8 wherein the fraction of (b) dots is at least 0.1 and less than 0.98.

10. The method of any of embodiments 1 to 9 wherein the fraction of the plurality of (b) dots is at least 0.25 and less than 0.9.

11. The method of any of embodiments 1 to 10 wherein the (a) dots are distributed uniformly among the (b) dots in the sub-area.

12. The method of any of embodiments 1 to 11 further comprising:

printing a halftone image with the flexographic printing member on a receiver element to obtain gray shades or ink densities below a predetermined shade of gray or ink density in a sub-area of the receiver element corresponding to the sub-area of the flexographic printing member.

13. The method of any of embodiments 1 to 12 wherein the (b) dots are provided by laser engraving to have topmost surfaces that are undercut at least 10 μm and up to and including 200 μm below the elastomeric topmost surface of the image area.

14. The method of any of embodiments 1 to 13 wherein the (b) dots are provided by laser engraving to have topmost surfaces that are undercut at least 20 μm and up to and including 75 μm below the elastomeric topmost surface of the image area.

15. The method of any of embodiments 1 to 14 wherein each (b) dot is provided to have an essentially flat top surface.

16. The method of any of embodiments 1 to 14 wherein each (b) dot is provided to have a curved top surface.

17. The method of any of embodiments 1 to 16 wherein the (b) dots are provided to have topmost surfaces that are below the elastomeric topmost surface by the same or different depths in a predetermined amount sufficient to provide a desired average print density within a unit area of the receiver element.

18. The method of any of embodiments 1 to 17 wherein the angle of the walls of at least one (b) dot, with respect to the elastomeric topmost surface, as viewed in cross-section, is not perpendicular to the relief image floor.

19. The method of any of embodiments 1 to 18 wherein the angle of the walls of at least one (a) dot, with respect to the elastomeric topmost surface, as viewed in cross-section, is not perpendicular to the relief image floor.

20. The method of any of embodiments 1 to 19 wherein at least some of the (b) dots are engraved to have multiple geometric shapes.

The invention has been described in detail with particular reference to certain preferred embodiments thereof, but it will be understood that variations and modifications can be effected within the spirit and scope of the invention.

The invention claimed is:

1. A method for providing a relief image in a flexographic printing member that is useful to transfer ink from an image area of the relief image to a corresponding image area of a receiver element, the method comprising:

removing elastomeric material from an elastomeric composition that has an elastomeric topmost surface, to provide a relief image comprising an image area in the elastomeric topmost surface, wherein:

the removing of elastomeric material provides a plurality of dots consisting of (a) dots and (b) dots within a sub-area of the elastomeric topmost surface, each of the (a) dots and (b) dots having a minimum receiver element contact area, the difference between the elastomeric topmost surface and the top surface of each of the (a) dots is no more than 10 μm as the (a) dots are not purposely undercut and have a topmost surface that is essentially coincident with the elastomer topmost surface, and are uniformly distributed among the (b) dots, the (b) dots represent a fraction of less than 1 of the plurality of dots and each of the (b) dots within the sub-area has a topmost surface that is below the elastomeric topmost surface by at least 10 μm, and the (b) dots being undercut below the elastomeric topmost surface in a predetermined number and arrangement so that the (b) dots are still able to transfer ink to the receiver element, thereby providing a flexographic printing member with a relief image that has an image area.

2. The method of claim 1 wherein the elastomeric material is removed to provide the relief image in the image area using direct laser engraving.

3. The method of claim 1 wherein the elastomeric composition is provided on a non-laser engraveable substrate.

4. The method of claim 1 wherein the elastomeric composition comprises an elastomer, a crosslinked elastomer, or a vulcanized rubber.

5. The method of claim 1 that provides a substantially planar flexographic printing plate.

6. The method of claim 1 that provides a flexographic printing sleeve or cylinder with a curved elastomeric topmost surface.

7. The method of claim 1 comprising engraving all of the (b) dots so that they have topmost surfaces that are below the elastomeric topmost surface by essentially the same depth.

8. The method of claim 1 comprising engraving all of the (b) dots so that they have topmost surfaces that are below the elastomeric topmost surface by two or more different depths in a predetermined arrangement.

9. The method of claim 1 wherein the fraction of (b) dots is at least 0.1 and less than 0.98 of the plurality of dots.

10. The method of claim 1 wherein the fraction of the plurality of (b) dots is at least 0.25 and less than 0.9 of the plurality of dots.

11. The method of claim 1 wherein the (a) dots are distributed uniformly among the (b) dots in the sub-area.

12. The method of claim 1 further comprising:

printing a halftone image with the flexographic printing member on a receiver element to obtain gray shades or ink densities below a predetermined shade of gray or ink density in a sub-area of the receiver element corresponding to the sub-area of the flexographic printing member.

13. The method of claim 1 wherein the (b) dots are provided by laser engraving to have topmost surfaces that are undercut at least 10 μm and up to and including 200 μm below the elastomeric topmost surface of the image area.

14. The method of claim 1 wherein the (b) dots are provided by laser engraving to have topmost surfaces that are undercut at least 20 μm and up to and including 75 μm below the elastomeric topmost surface of the image area.

15. The method of claim 1 wherein each (b) dot is provided to have an essentially flat top surface.

16. The method of claim 1 wherein each (b) dot is provided to have a curved top surface.

17. The method of claim 1 wherein the (b) dots are provided to have topmost surfaces that are below the elastomeric topmost surface by the same or different depths in a predetermined amount sufficient to provide a desired average print density within a unit area of the receiver element.

18. The method of claim 1 wherein the angle of the walls of at least one (b) dot, with respect to the elastomeric topmost surface, as viewed in cross-section, is not perpendicular to the relief image floor.

19. The method of claim 1 wherein the angle of the walls of at least one (a) dot, with respect to the elastomeric topmost surface, as viewed in cross-section, is not perpendicular to the relief image floor.

20. The method of claim 1 wherein at least some of the (b) dots are engraved to have multiple geometric shapes.

* * * * *